US009380829B2

(12) United States Patent
Lee

(10) Patent No.: US 9,380,829 B2
(45) Date of Patent: Jul. 5, 2016

(54) SHOCK-ABSORBING WALK-AIDING SHOE

(75) Inventor: Sin-Lun Lee, Kaohsiung (TW)

(73) Assignee: Sin-Lun Lee, Kaohsiung (TW)

( * ) Notice: Subject to any disclaimer, the term of this patent is extended or adjusted under 35 U.S.C. 154(b) by 910 days.

(21) Appl. No.: 13/533,804

(22) Filed: Jun. 26, 2012

(65) Prior Publication Data

US 2013/0340293 A1 Dec. 26, 2013

(51) Int. Cl.

| | |
|---|---|
| ***A43B 7/20*** | (2006.01) |
| ***A63B 21/00*** | (2006.01) |
| ***A63B 23/08*** | (2006.01) |
| ***A43B 7/14*** | (2006.01) |

(52) U.S. Cl.

CPC ... *A43B 7/20* (2013.01); *A43B 7/14* (2013.01); *A43B 7/1495* (2013.01); *A63B 21/143* (2013.01); *A63B 23/085* (2013.01)

(58) Field of Classification Search

CPC ..... A43B 7/18; A43B 7/19; A43B 7/20; A43B 7/32; A43B 7/1495; A43B 7/00; A43B 7/15; A43B 5/00; A63B 21/143; A63B 23/085

USPC ..... 36/132, 136, 114, 115, 116, 89; 482/79, 482/74, 44

See application file for complete search history.

(56) References Cited

U.S. PATENT DOCUMENTS

| | | | | |
|---|---|---|---|---|
| 5,109,614 | A * | 5/1992 | Curry | 36/100 |
| 5,269,078 | A * | 12/1993 | Cochrane | 36/93 |
| 5,672,156 | A * | 9/1997 | Jimenez Ramos | 602/27 |
| 5,865,778 | A * | 2/1999 | Johnson | 602/27 |
| 7,334,354 | B2 * | 2/2008 | Foxen et al. | 36/89 |
| 7,458,950 | B1 * | 12/2008 | Ivany | 602/28 |
| 8,480,546 | B2 * | 7/2013 | Spencer | 482/74 |
| 2005/0108900 | A1 * | 5/2005 | Knowles | 36/89 |
| 2005/0198869 | A1 * | 9/2005 | Bouche et al. | 36/89 |
| 2009/0000150 | A1 * | 1/2009 | Wong | 36/89 |
| 2010/0304937 | A1 * | 12/2010 | Spencer | 482/79 |
| 2011/0302808 | A1 * | 12/2011 | Yu et al. | 36/88 |

* cited by examiner

*Primary Examiner* — Jila M Mohandesi

(57) ABSTRACT

A shock-absorbing walk-aiding shoe includes a shoe main body, at least one elastic extensible belt and at least one connection member fixedly disposed on the elastic extensible belt. By means of the connection member fixedly disposed on the elastic extensible belt, the elastic extensible belt is fastened between an upper face of the shoe main body and a heel. When a user's foot treads onto the ground, the elastic extensible belt is elastically tensioned and the angle of the user's foot is changed to provide an elastic restoring force for the shoe main body to absorb the impact to the foot. Also, the elastic restoring force can be converted into an aiding force in lifting the foot away from the ground in the next move of the foot. Accordingly, the shock-absorbing walk-aiding shoe can provide a shock absorption effect and help the user in walking.

10 Claims, 8 Drawing Sheets

SHOCK-ABSORBING WALK-AIDING SHOE

The current application claims a foreign priority to the application of Korea 10-2012-0044700 filed on Apr. 27, 2012.

BACKGROUND OF THE INVENTION

1. Field of the Invention

The present invention relates generally to a shock-absorbing walk-aiding shoe, and more particularly to a shoe body structure, which can help a user in walking and provide a shock absorption effect.

2. Description of the Related Art

In daily life, the shoes are very important implements for protecting feet. When walking or exercising, the shoes more or less can absorb the reaction force exerted onto the feet by the ground so as to buffer the impact to the bones of the feet and knees and protect the feet and knees from getting injured. However, the shock absorption effect provided by the conventional shoes is quite limited and poor.

Furthermore, when walking, a user will lift his/her feet and then tread onto the ground. In such movement, the muscles of the legs are forced and tensioned and the knees bear a considerably great force when treading on the ground. Therefore, after a period of walking, the user's feet are likely to feel sore. In case the user neglects the soreness and keeps walking for a long time, the feet of the user may get injured. To overcome the above problem, many manufacturers have developed various improved shoes with elastic structures such as air envelopes for absorbing impact and reaction force exerted onto the feet in treading.

The air envelopes of the conventional elastic shoe body can provide shock absorption effect. However, in fact, the air envelopes can only provide shock absorption effect. When walking, a person will usually contact the ground first at front end of the sole, the middle of the sole or the heel according to his/her personal habit. When leaving the ground, usually the front end of the sole will apply a force to the ground to lift the foot. The treading pressure applied to the foot is varied with the walking attitude. Therefore, the conventional elastic shoe body structure can only relieve the sole from the pressure, while failing to help in lifting or lowering the foot. As a result, when walking, the feet will still feel sore and tired due to repeated lifting and lowering movements. The extent to which the feet feel sore is varied with the manner in which the feet are lifted. Accordingly, the practicality of the conventional elastic shoe body is quite limited.

SUMMARY OF THE INVENTION

It is therefore a primary object of the present invention to provide a shoe body structure. When a user's foot treads onto the ground, the shoe body structure can effectively absorb the impact to the foot. The shoe body structure has at least one elastic extensible belt fastened between a front side of the user's shin and a heel of the shoe body to provide an upward elastic restoring force for the shoe body to absorb the impact to the foot. Also, the elastic restoring force can be converted into an aiding force in quickly lifting the foot away from the ground. Accordingly, the shoe body structure can provide a shock absorption effect and help the user in walking.

To achieve the above and other objects, the shock-absorbing walk-aiding shoe of the present invention includes a shoe main body, a protection soft pad upward connected to and upward extending from an upper face of the shoe main body, a locating fabric flap disposed on the protection soft pad, at least one elastic extensible belt and at least one connection member fixedly disposed on the elastic extensible belt.

The protection soft pad includes a fabric layer, a foam rubber layer and two fastening straps extending from two sides of the protection soft pad. The two fastening straps can be wound over a user's shin and securely connected to each other so as to attach the foam rubber layer to the shin for protecting the shin.

The locating fabric flap includes a fabric-made main body, a loop fastener tape disposed on an inner face of the main body and a hook fastener tape disposed on the protection soft pad corresponding to the loop fastener tape.

The elastic extensible belt has at least one belt main body, at least one locating plate connected with the belt main body and a hook fastener tape disposed on one face of the locating plate. A corresponding loop fastener tape is disposed on the protection soft pad. The hook fastener tape can be fastened to the loop fastener tape to detachably connect the elastic extensible belt with the protection soft pad.

The connection member is preferably a hanging hook or a latch ring fixedly disposed on the elastic extensible belt.

The locating plate of the elastic extensible belt is fastened to the protection soft pad and located by means of the locating fabric flap. The connection member is secured to the heel of the shoe main body so as to fasten the elastic extensible belt between two sides of the protection soft pad and the heel of the shoe main body. In this case, the elastic extensible belt is tensioned to provide an elastic restoring force for the shoe main body to help in lifting the foot. Moreover, when the user's foot treads onto the ground, the elastic extensible belt is elastically tensioned to provide an elastic restoring force for the shoe main body to absorb the impact to the foot. Therefore, the shock-absorbing walk-aiding shoe can provide a shock absorption effect and help the user in walking.

The present invention can be best understood through the following description and accompanying drawings, wherein:

DETAILED DESCRIPTION OF THE PREFERRED EMBODIMENT

Figure 1:
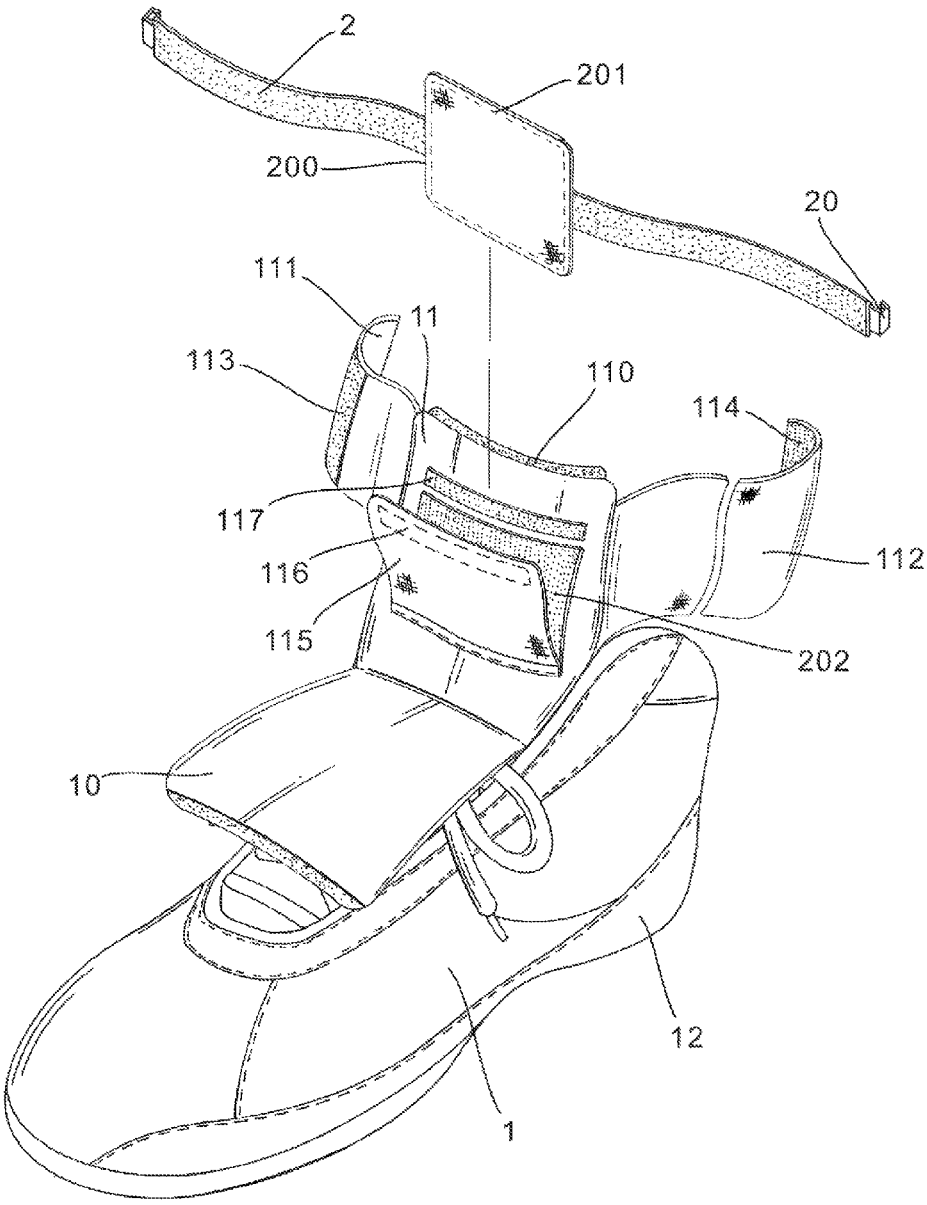
FIG. 1 is a perspective exploded view of the shoe body of the present invention.

Please refer to FIGS. 1 to 6. According to a preferred embodiment, the shock-absorbing walk-aiding shoe of the present invention includes a shoe main body 1, a protection soft pad 11 extending from a bottom of the tongue 10 of the shoe main body 1, a locating fabric flap 115 disposed on the protection soft pad 11, at least one elastic extensible belt 2 and connection members 20 fixedly disposed on the elastic extensible belt 2.

Figure 5:
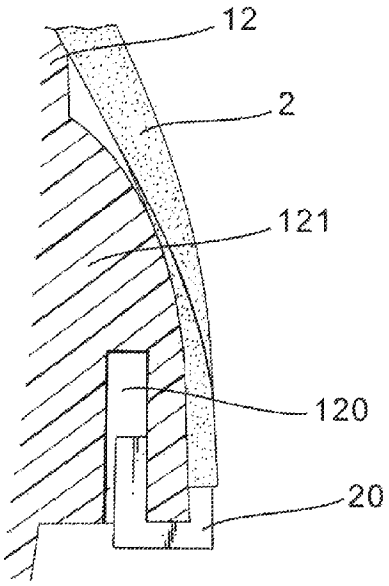
FIG. 5 is a sectional view showing that the elastic extensible belt of the shoe body of the present invention is fixedly hooked.
Figure 4:
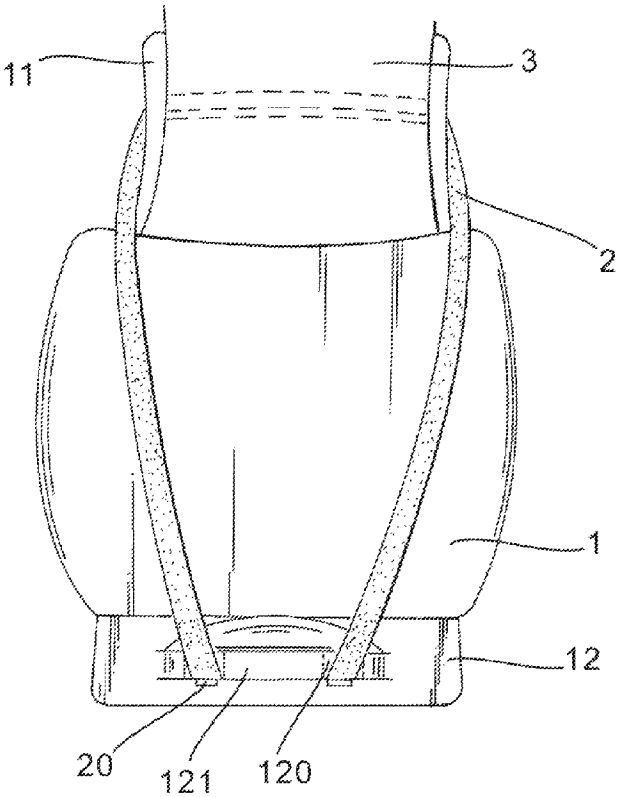
FIG. 4 is a rear view of the shoe body of the present invention according to FIG. 3.

The shoe main body 1 is for a user's foot to fit in. The shoe main body 1 includes a heel 12 disposed on a rear side of the shoe main body 1 and a fixing structure integrally formed with the heel 12. The fixing structure includes at least one fixing seat main body 121 and a locating socket 120 formed in the fixing seat main body 121. The connection members 20 of the elastic extensible belt 2 are secured to the locating socket 120 (as shown in FIGS. 4 and 5).

Figure 3:
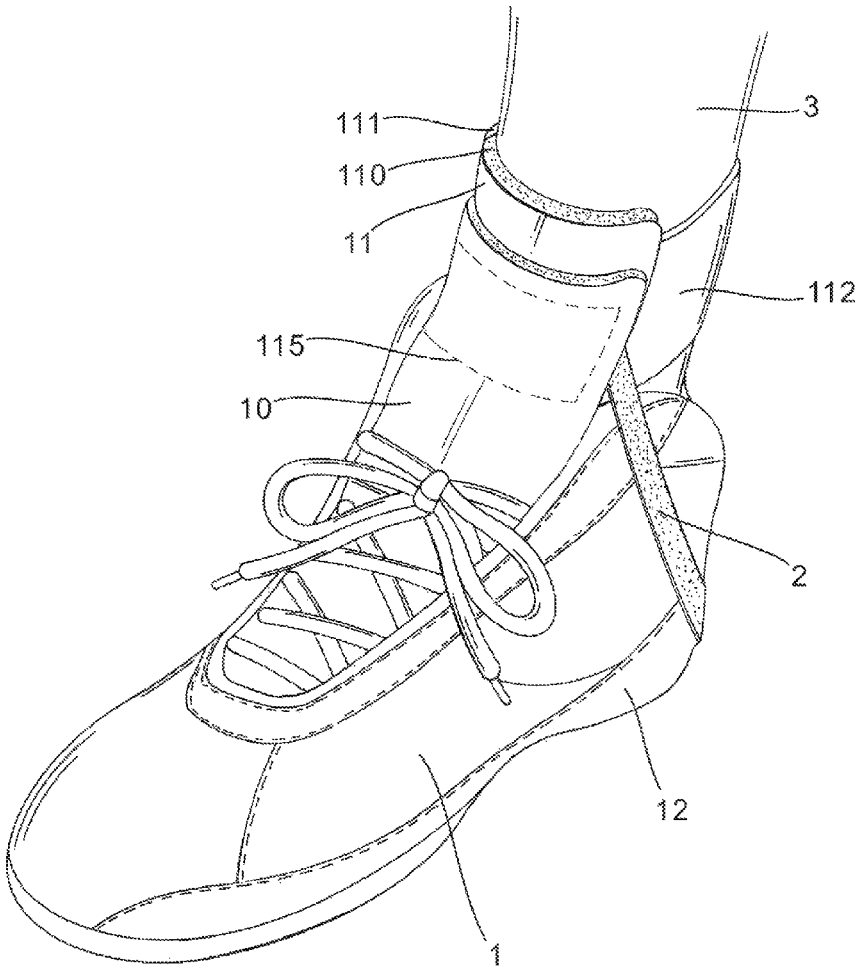
FIG. 3 is a perspective view of the shoe body of the present invention, showing that a user wears the shoe body on one foot.

The protection soft pad 11 is connected to the bottom of the tongue 10 on upper side of the shoe main body 1. The protection soft pad 11 upward extends by a predetermined length. The main body of the protection soft pad 11 is made of fabric material. A foam rubber layer 110 is disposed on an inner face of the main body of the protection soft pad 11. Two fastening straps 111, 112 rearward extend from left and right sides of the protection soft pad 11 respectively. A fastening member is disposed on an inner face of the left fastening strap 111. In this embodiment, the fastening member is a loop fastener tape 113. A fastening member corresponding to the fastening member of the left fastening strap 111 is disposed on an outer face of the right fastening strap 112. In this embodiment, the fastening member of the right fastening strap 112 is a hook fastener tape 114. After the two fastening straps 111, 112 are wound over the shin 3, the loop fastener tape 113 and the hook fastener tape 114 are fastened to each other to make the foam rubber layer 110 snugly attach to the shin 3 for protecting the shin 3 (as shown in FIGS. 1 and 3).

The locating fabric flap 115 is disposed on an upper face of the protection soft pad 11 by unilateral sewing. The locating fabric flap 115 mainly includes a fabric-made main body, a fastening member disposed on an inner face of the main body and a fastening member correspondingly disposed on a fabric face of the protection soft pad 11. In this embodiment, the fastening members are loop fastener tape 116 and hook fastener tape 117. The loop fastener tape 116 and the hook fastener tape 117 can be fastened to each other to securely attach the locating fabric flap 115 onto the protection soft pad 11 (as shown in FIG. 1).

The elastic extensible belt 2 has a belt main body, which is an elongated elastic belt body. At least one fabric-made locating plate 200 is connected with a middle section of the belt main body. A hook fastener tape 201 is disposed on one face of the locating plate 200 and a corresponding loop fastener tape 202 is disposed on the protection soft pad 11. The hook fastener tape 201 can be fastened to the loop fastener tape 202 to detachably connect the elastic extensible belt 2 with the protection soft pad 11.

In this embodiment, the connection members 20 are, but not limited to, hanging hooks or latch rings for illustration purposes only. The connection members 20 are fixedly disposed on the belt main body of the elastic extensible belt 2 (as shown in FIG. 1).

Figure 2:
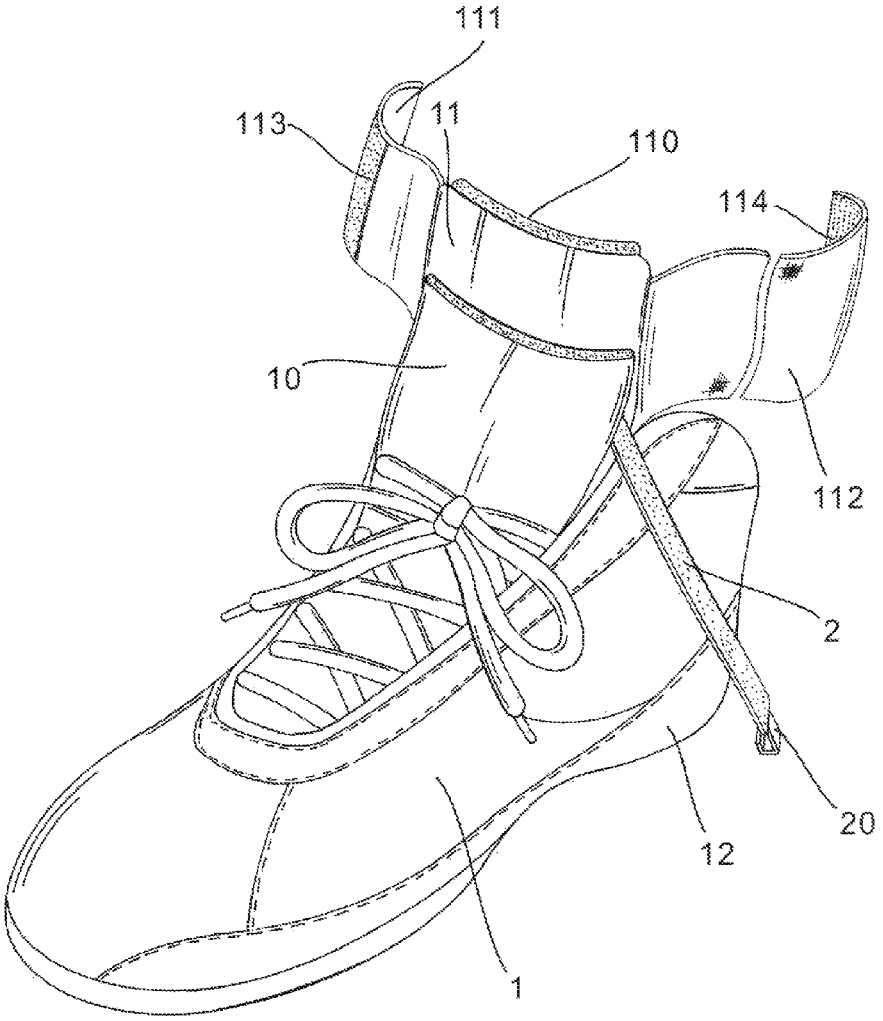
FIG. 2 is a perspective assembled view of the shoe body of the present invention.

When assembled, the locating plate 200 of the elastic extensible belt 2 is first directly fastened to the protection soft pad 11. Then the loop fastener tape 116 on the inner face of the locating fabric flap 115 is directly securely attached to the hook fastener tape 117 on the protection soft pad 11 so as to firmly locate the elastic extensible belt 2. In this case, two ends of the elastic extensible belt 2 will naturally suspend from two sides of the shoe main body 1 (as shown in FIG. 2).

Figure 6:
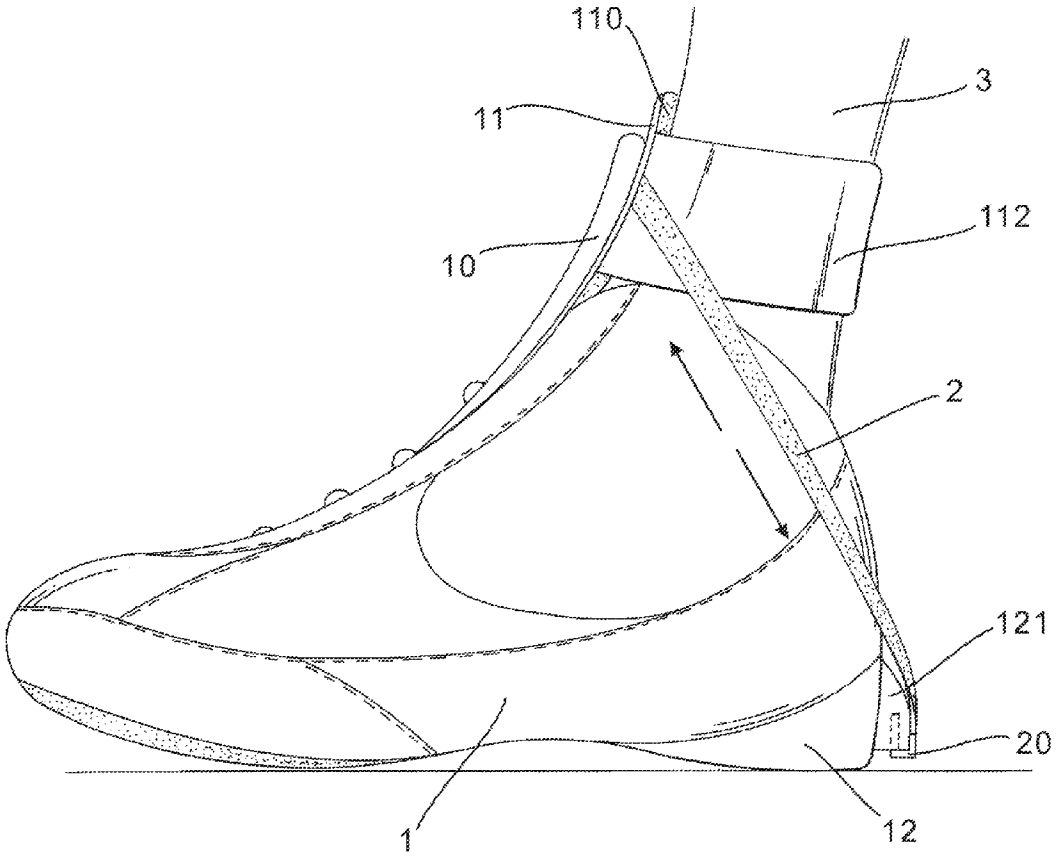
FIG. 6 is a side view of the shoe body of the present invention, showing that the elastic extensible belt is extended.

When wearing the shoe, a user's foot is fitted into the shoe main body 1 and the fastening straps 111, 112 extending from two sides of the protection soft pad 11 are wound over the shin 3 of the user. Thereafter, the hook and loop fastener tapes 113, 114 are fastened to each other to make the foam rubber layer 110 snugly attach to the front side of the shin 3. Then, the connection members 20 fixedly disposed on the elastic extensible belt 2 are directly affixed to the fixing seat main body 121 protruding from the heel 12 of the shoe main body 1. Under such circumstance, the connection members 20 hook the locating socket 120 to make the elastic extensible belt 2 in an elastically tensioned state. Accordingly, when the user lifts his/her foot fitted in the shoe main body, the elastic extensible belt 2 provides an elastic pull force for the foot to quickly leave the ground (as shown in FIGS. 4, 5 and 6).

Figure 7:
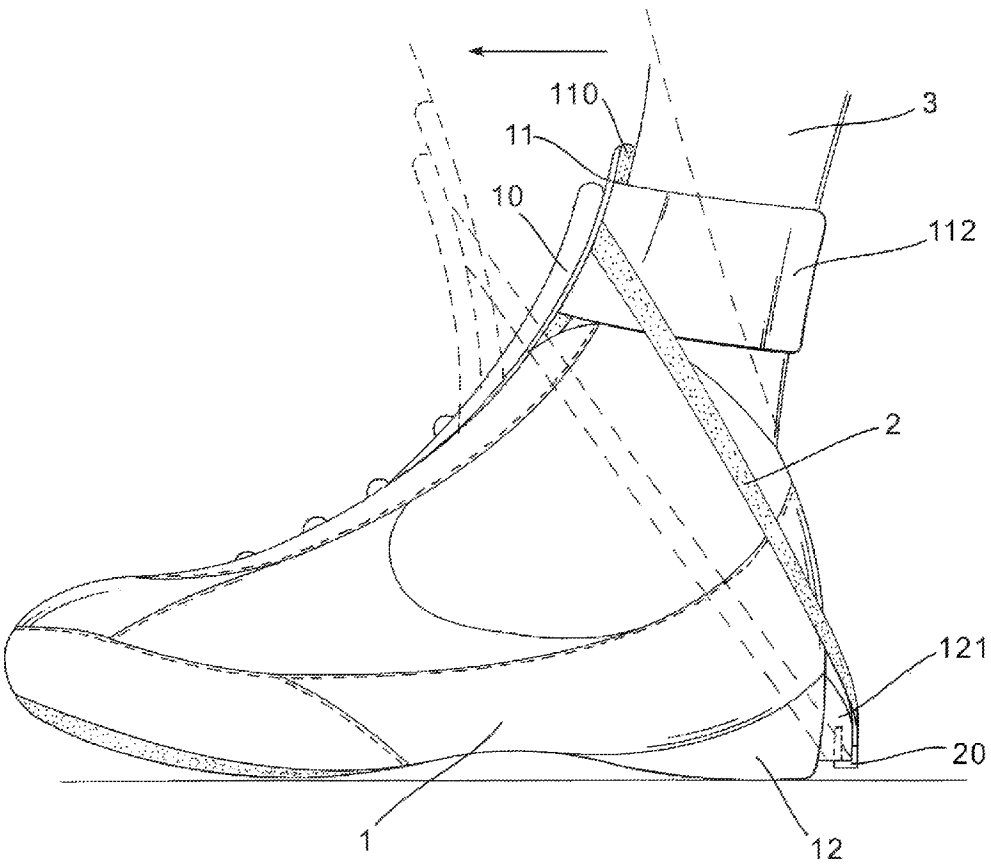
FIG. 7 is a side view according to FIG. 6, showing that the user lifts his/her foot and starts to walk.
Figure 8:
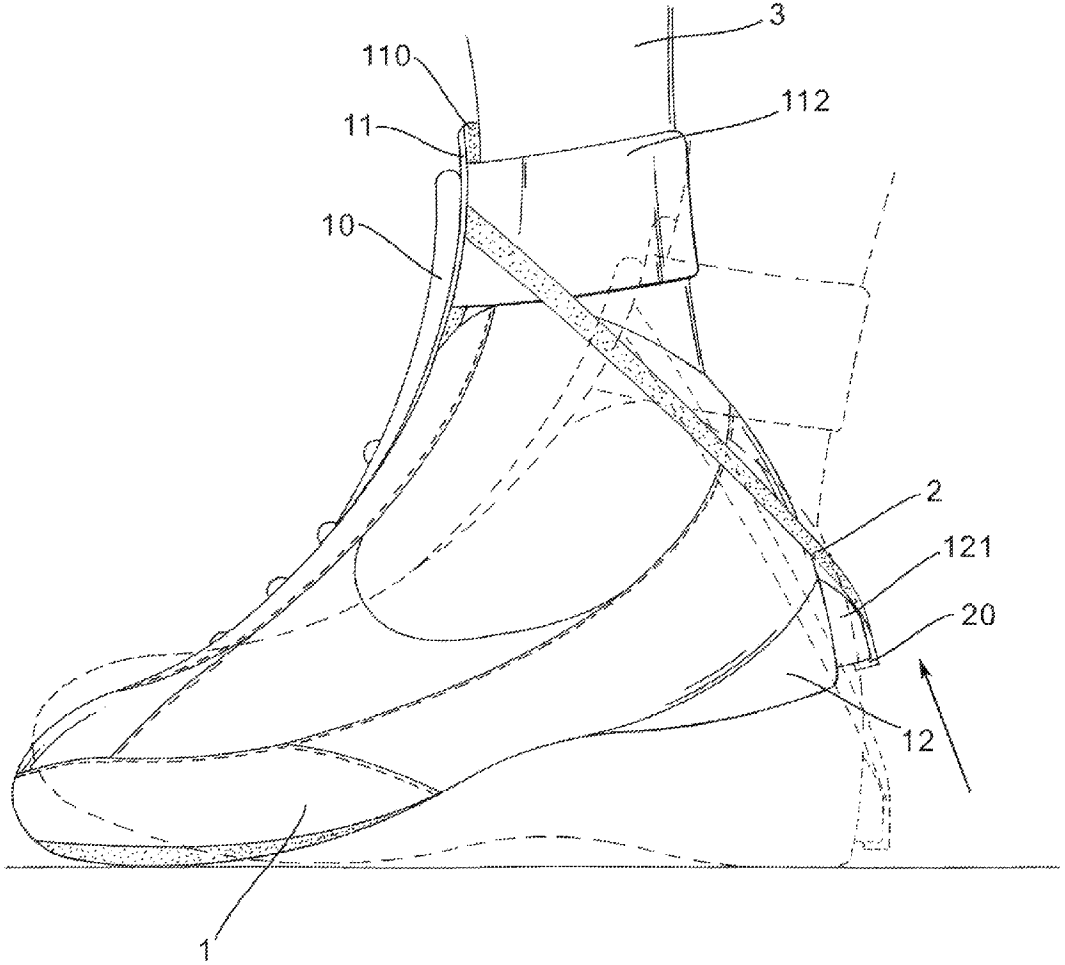
FIG. 8 is a side view according to FIG. 6, showing the walk of the user.
Figure 9:
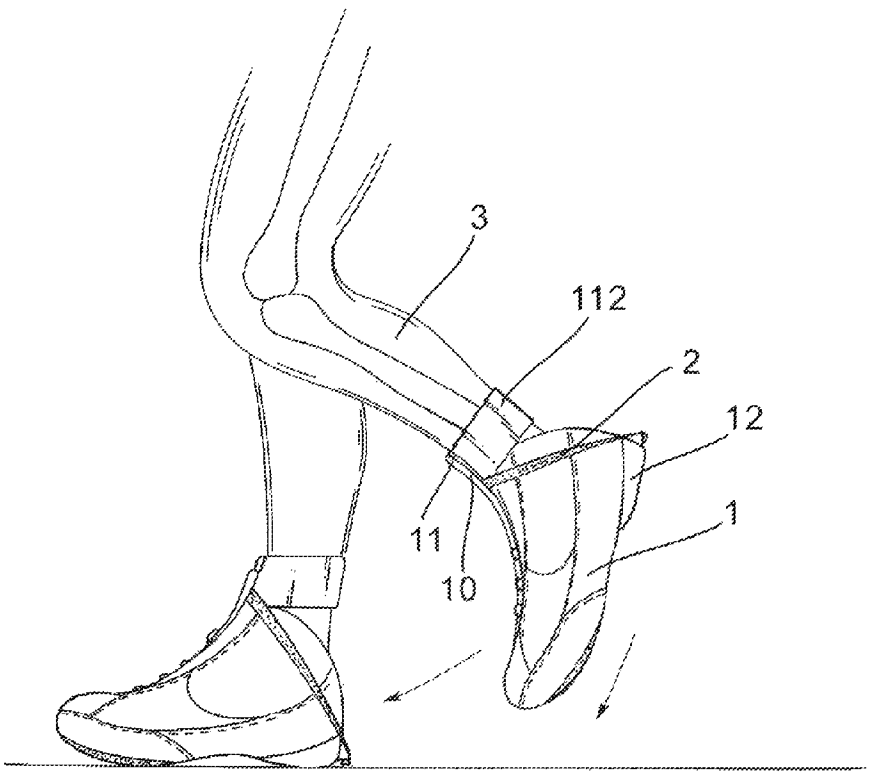
FIG. 9 is a side view according to FIG. 6, showing that the heel of the shoe body of the present invention treads onto the ground.

When the user starts to exercise or walk and lifts his/her foot, the shin 3 of the user will be tilted forward to extend the elastic extensible belt 2 and elongate the length thereof. In this case, the elastic force of the elastic extensible belt 2 is increased (as shown in FIG. 7). By means of the elastic pull force of the elastic extensible belt 2, the heel 12 is pulled up into a tiptoeing attitude (as shown in FIG. 8). At this time, the elastic extensible belt 2 is slightly relaxed to slightly shorten the length of the elastic extensible belt 2. Accordingly, the elastic extensible belt 2 can provide an aiding pull force for the muscle of the shin 3 to save strength. At the same time, the user can adjust the treading attitude of the foot (as shown in FIG. 9). When treading onto the ground, the user can tilt up his/her tiptoes to change the angle of his/her foot and again elastically tension the elastic extensible belt 2 to provide an elastic restoring force for offsetting the impact exerted onto the foot when treading on the ground. In this case, the knee of the user is protected from being injured under the impact and the foot of the user is protected from being sprained due to stumble. Also, the elastic restoring force can be converted into the aiding force in lifting the foot away from the ground in the next move of the foot. In conclusion, the shock-absorbing walk-aiding shoe of the present invent ion can provide a shock absorption effect and help a user in walking.

The above embodiment is only used to illustrate the present invention, not intended to limit the scope thereof. Many modifications of the above embodiment can be made without departing from the spirit of the present invention.

What is claimed is:

1. A shock-absorbing walk-aiding shoe comprising:

a shoe main body for a user's foot to fit in, the shoe main body including a heel disposed on a rear side of the shoe main body and at least one fixing structure disposed on the heel, the fixing structure including a fixing seat main body and a locating socket formed in the fixing seat main body;

a protection soft pad connected to an upper face of the shoe main body, the protection soft pad including a main body, two fastening straps extending from two sides of the main body and fastening members disposed on the fastening straps, wherein the fastening straps can be wound over a user's shin to fasten the fastening members to each other;

a locating fabric flap disposed on the protection soft pad, the locating fabric flap including a main body, a fastening member disposed on an inner face of the main body and a fastening member disposed on the protection soft pad, wherein the two fastening members can be fastened to each other to securely attach the locating fabric flap onto the protection soft pad;

at least one elastic extensible belt fixedly disposed on the protection soft pad, the locating fabric flap being overlaid on the elastic extensible belt to locate the elastic extensible belt on the protection soft pad, the elastic extensible belt has an elongated belt main body;

at least one locating plate integrally connected with the belt main body, a hook fastener tape being disposed on one face of the locating plate and a corresponding loop fastener tape being disposed on the protection soft pad, the hook fastener tape being fastened to the loop fastener tape to detachably connect the elastic extensible belt with the protection soft pad; and at least one connection member fixedly disposed on the elastic extensible belt, the connection member being secured to the locating socket of the heel of the shoe main body so as to fasten the elastic extensible belt between two sides of the protection soft pad and the heel, whereby when the user walks or exercises to tread on the ground, the elastic extensible belt can provide an elastic restoring force for the shoe main body for absorbing impact to the user's foot and the elastic restoring force can be converted into an aiding force in lifting the foot in the next move.

2. The shock-absorbing walk-aiding shoe as claimed in claim 1, wherein the main body of the protection soft pad is made of fabric material.

3. The shock-absorbing walk-aiding shoe as claimed in claim 1, wherein a foam rubber layer is disposed on an inner face of the main body of the protection soft pad.

4. The shock-absorbing walk-aiding shoe as claimed in claim 1, wherein the connection member of the elastic extensible belt is a hanging hook member.

5. The shock-absorbing walk-aiding shoe as claimed in claim 1, wherein the connection member of the elastic extensible belt is a latch ring securable to the fixing structure of the heel of the shoe main body.

6. The shock-absorbing walk-aiding shoe as claimed in claim 1, wherein the fixing structure of the heel of the shoe main body is a latch body and the connection member is a latch ring, whereby the latch ring can be latched with the latch body.

7. The shock-absorbing walk-aiding shoe as claimed in claim 1, the fixing structure of the heel of the shoe main body is integrally formed with the heel of the shoe main body.

8. The shock-absorbing walk-aiding shoe as claimed in claim 1, wherein the fastening members of the fastening straps of the protection soft pad are loop and hook fastener tapes.

9. The shock-absorbing walk-aiding shoe as claimed in claim 1, wherein the fastening member of the main body of the locating fabric flap and fastening member of the protection soft pad are loop and hook fastener tapes.

10. The shock-absorbing walk-aiding shoe as claimed in claim 1, wherein the main body of the locating fabric flap is made of fabric material.

* * * * *